United States Patent [19]

Silverberg

[11] Patent Number: 4,593,897

[45] Date of Patent: Jun. 10, 1986

[54] BOTTOM STACKING WITH AIR KNIFE LEVITATION AND ARTICULATING SEALS

[75] Inventor: Morton Silverberg, Rochester, N.Y.

[73] Assignee: Xerox Corporation, Stamford, Conn.

[21] Appl. No.: 654,703

[22] Filed: Sep. 27, 1984

[51] Int. Cl.[4] ..... B65H 31/08

[52] U.S. Cl. ..... 271/212; 271/195; 271/197

[58] Field of Search ..... 271/212, 195–197

[56] References Cited

U.S. PATENT DOCUMENTS

| | | | |
|---|---|---|---|
| 3,007,698 | 11/1961 | MacDonald | 271/212 |
| 3,396,966 | 8/1968 | Solheim | 271/86 |
| 3,934,869 | 1/1976 | Strobel, Jr. | 271/35 |
| 3,947,018 | 3/1976 | Stange | 271/99 |
| 3,971,554 | 7/1976 | Stange | 271/212 X |
| 4,014,537 | 3/1977 | Stange | 271/166 |
| 4,030,727 | 6/1977 | Jeschke | 271/276 |
| 4,162,067 | 7/1979 | Horak et al. | 271/177 |
| 4,181,298 | 1/1980 | Capdeboscq | 271/5 |
| 4,189,140 | 2/1980 | Swanson | 271/212 |
| 4,368,973 | 1/1983 | Silverberg | 271/212 X |
| 4,478,404 | 10/1984 | Garavuso | 271/212 |

FOREIGN PATENT DOCUMENTS

| | | | |
|---|---|---|---|
| 0020973 | 5/1980 | European Pat. Off. . | |
| 21876 | 9/1961 | German Democratic Rep. | 271/212 |
| 37959 | 4/1981 | Japan | 271/212 |

*Primary Examiner*—Richard A. Schacher

*Attorney, Agent, or Firm*—William A. Henry, II

[57] ABSTRACT

An apparatus for inserting sheets under the bottom of a stack of sheets including a positive air pressure source that provides an air cushion between the bottom sheet in the stack of sheets and the stack tray. The air pressure source has articulated seal means attached thereto that are adapted to increase the efficient use of the air pressure source. Drive belts feed sheets under the stack of sheets in cooperation with a vacuum source that deflects sheets against the belts until they reach a point in their forward movement of coming under the influence of the positive air pressure source and are thereby floated up to the bottom of the stack of sheets.

11 Claims, 3 Drawing Figures

BOTTOM STACKING WITH AIR KNIFE LEVITATION AND ARTICULATING SEALS

BACKGROUND OF THE INVENTION

This invention relates to recirculating automatic document feed devices for copying machines, and more particularly, to an improved bottom stacker for use in such devices.

The advantages of a recirculating automatic document feeder (RADF) is well known in the art. For example, one such advantage is the ability to recirculate a multi-sheet original document, making one copy per circulation, such that the copy output comprises a single stack of many collated copy sets without the necessity of providing an output multi-bin collator. This pre-collation copying is sometimes accomplished by feeding the multi-sheets of the original document from the top of the stack and insert each sheet after copying in the bottom of the stack.

Some of the problems encountered with RADFs of the top feed/bottom stack variety include the tendancy for sheets to fold as they reenter the bottom of the stack due to curl induced into the sheets by transport rollers, wrinkle from misalignment of sheets as they reenter the bottom of the stack and the inability of the RADFs to accomodate extremely lightweight sheets.

PRIOR ART

Various solutions to bottom stacking problems have been exhibited. For example, U.S. Pat. No. 3,947,018 discloses the use of air flotation and a vacuum roll or belt assembly to minimize drag forces on a sheet being inserted or removed from the bottom of a stack of sheets. In U.S. Pat. No. 3,396,966 a sheet stacking apparatus is shown that includes a guide that prevents previously stacked sheets from blocking the entry of a sheet being placed at the bottom of a stack of sheets and to prevent the sheet being introduced into the stack from damaging a sheet previously placed at the bottom of the stack. Air is injected into the stack of sheets in order to separate them.

An air assisted document stacking apparatus is disclosed in U.S. Pat. No. 4,162,067 that employs an elongated drive belt to entrain and move items into a stacker pocket with the pocket having means for applying positive air pressure thereto so as to move incoming items out of the path of following items entering the pocket and for applying negative pressure to the pocket for closely stacking items together in the pocket by removing residual air from between the items.

Another known sheet stacker apparatus is in U.S. Pat. No. 4,189,140 which shows the use of vacuum belts to hold sheets in shingled from while in transit to a stacking station.

Notwithstanding the solutions in the above-mentioned patents, problems still arise since a stack of sheets must be lifted while a single sheet is inserted under the stack which in some applications could include approximately 100 sheets.

SUMMARY OF THE INVENTION

Accordingly, in accordance with one aspect of the present invention, a top feed/bottom stacker is disclosed that levitates a stack of sheets while sheets are inserted under the stack and includes an air knife that provides an air cushion between the bottom sheet in the stack and the stack tray. Articulating seal means are attached to the air knife and adaped to increase the efficient use of the air knife pressure by decreasing the loss of air from the front of the stack. Drive belts feed sheets under the stack in cooperation with a vaccum source that attaches sheets to the belts until they reach a point in their forward movement of coming under the influence of positive pressure from the air knife and are thereafter lifted up against the bottom of the stack.

Further features and advantages of the present invention pertain to the particular apparatus whereby the above-noted aspect of the invention is obtained. Accordingly, the invention will be better understood by reference to the following description, and to the drawings forming a part thereof, which are approximately to scale, wherein:

DESCRIPTION OF THE PREFERRED EMBODIMENT

Figure 1:
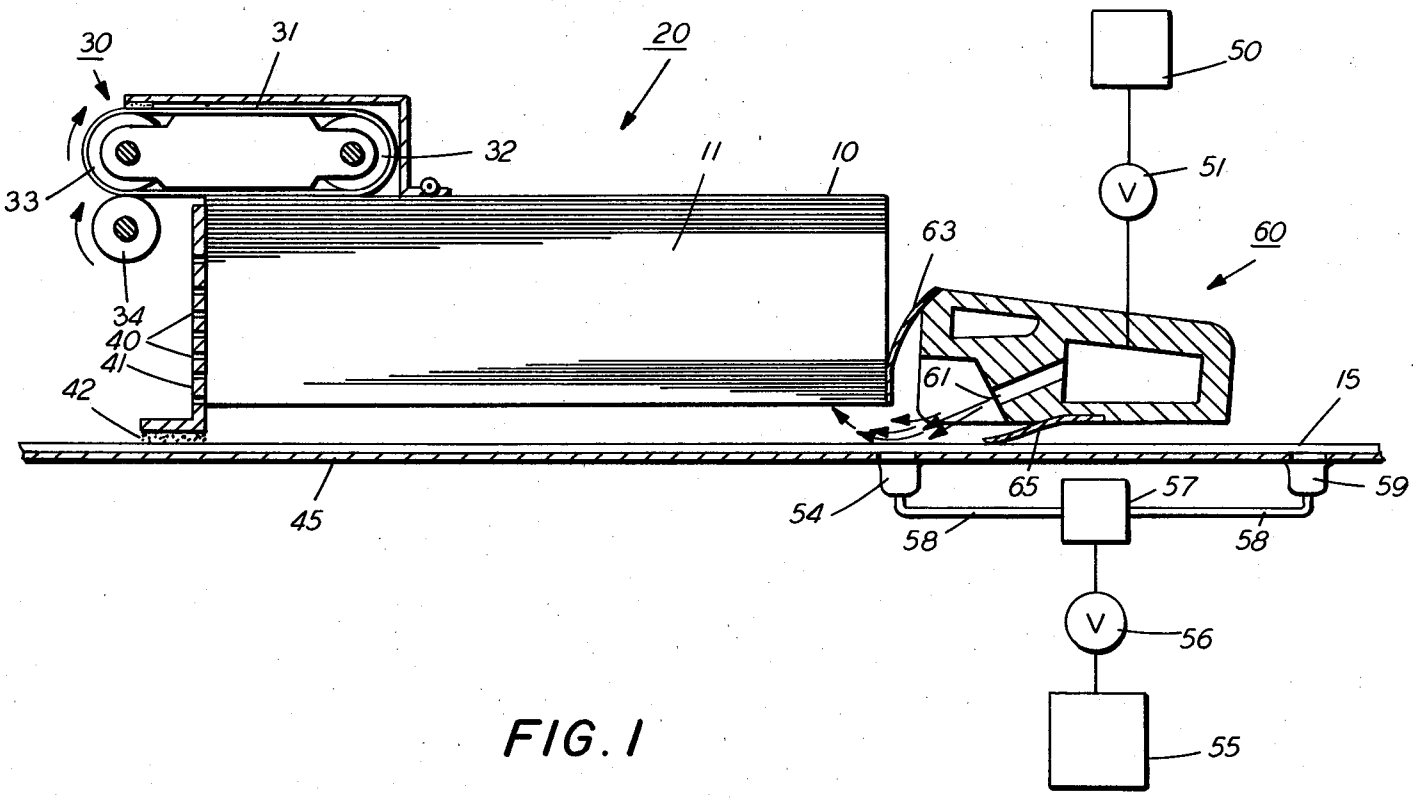
FIG. 1 is a partial elevational schematic view of the top feed/bottom stacker apparatus of the present invention.

While the present invention will be described in a preferred embodiment, it will be understood that it is not intended to limit the invention to that embodiment. On the contrary, it is intended to cover all alternatives, modifications and equivalents as may be included within the spirit and scope of the invention as defined by the appended claims.

The apparatus that encompasses the present invention will now be described in detail with reference to the Figures where like reference numerals will be employed throughout to designate identical elements. Although the apparatus for bottom stacking sheets is particularly well adapted for use as a part of a recirculating automatic document handler, it should be evident from the following discussion that it is equally well suited for use in any environment where bottom stacking of sheets is required and not necessarily limited in application to the particular embodiments shown.

Referring now to FIG. 1, the pneumatic extension bottom stacker and top feeder of the present invention 20 includes a conventional retard roll sheet feeding system 30 that has a belt 31 entrained around spaced apart rollers 32 and 33. While a friction retard feeder is disclosed herein, it should be understood that any top sheet feeder would be appropriate, especially vacuum corrugation feeders. In FIG. 1, belt 31 along with retard roller 34 forms a nip that separates and inhibit multifeeds from sheet stack 10. The stack of sheets is sealably enclosed above bottom plate 45 by end wall 41, side walls (not shown) and front wall 63. Seals 42 prevents any loss of air along the bottom of the side walls and end wall 41 while equilization pressure is maintained by exhaust holes 40 in end wall 41. Sheet transport belts 15 forward sheets toward stack 10 while the sheets are held on the belts by conventional means, such as, rollers until the sheets approach air knife 60 where sheet tacking to belts 15 is accomplished by vacuum source 55 that is connected to vacuum ports 54 and 59.

During the time of transport of sheets toward the stack, the stack of sheets are levitated by an air flow from positive pressure source 50 through regulator valve 51 to air knife 60 and out against stack 10 through nozzle 61 to allow incoming sheets to be inserted beneath the stack by belts 15 and a vacuum through ports 54 and 59 via vacuum source 55, valve 56, control valve 57 and branch pipes 58, which holds the incoming sheets down until their trail edges pass port 54. At this point, positive air pressure from nozzle 61 negates the pull from vacuum port 54 and lifts the sheets from belts 15 up against the bottom of sheet stack 10. It should be understood that belts 15 are preferably positioned such that the vacuum pull through ports 54 and 59 is drawn between the belts. Aternatively, the belts could ride over the top of the vacuum ports and have perforations in them to allow the vacuum ports to acquire the sheets. Further, one belt could be used if desired.

Figure 2:
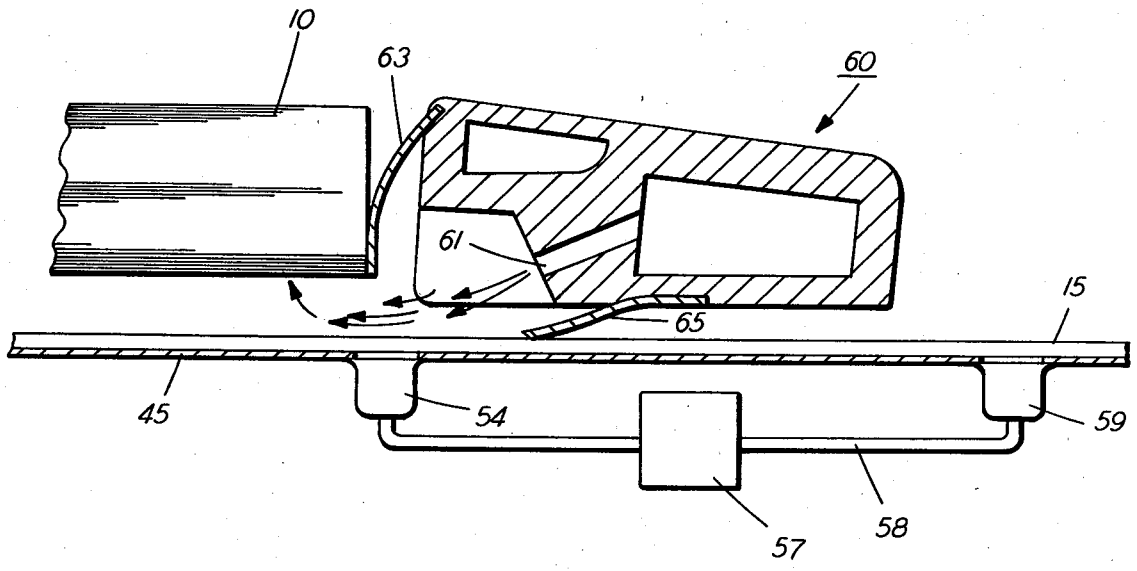
FIG. 2 is an exploded partial side view of the apparatus of FIG. 1 showing one aspect of the present invention.

As shown in FIGS. 1 and 2 and in accordance with one aspect of the present invention, sheets are fed toward stack 10 by belts 15 while any sheets already in the stack are levitated by a high flow of a positive air pressure through nozzle 61 of air knife 60. The air knife delivers a higher flow into vacuum port 54 and underneath stack 10 than the negative port can remove. The resulting delta, therefore, provides the flotation pressure required to support the stack. In order to maintain the high pressure from the air knife, the stack is sealed on all four sides. Preferably, the seals consist of multiple individual members which are balanced to light by contact on the stack sides. Air knife 60, in accordance with the present invention has deflectable, articulating seal 63 and 65 attached thereto that are moved against the stack and belt respectively by air pressure from the air knife, in order to increase the efficiency of the air knife by allowing less air to be wasted or escape. Seals 63 and 65 make for a more efficient device because more air from nozzle 61 is driven under the stack instead of up the front of the stack and out along the bottom surface of the air knife. Seal 65 is self energizing in that it is not inclined toward the stack.

In operation, a sheet is acquired by a first vacuum port 59 and held against belts 15 and transported by the belts toward the stack 10. A second vacuum port 54 is positioned immediately before the front edge of the stack and is adapted to pull the sheet against the belts until its trail edge passes the vacuum port. Since the positive pressure through nozzle 61 is greater than the negative pressure in port 54 and since the lead edge of the sheet is almost completely under the stack, the air pressure from air knife 60 is forced under the sheet and lifts it up against the bottom of sheets already levitated by the air pressure.

Figure 3:
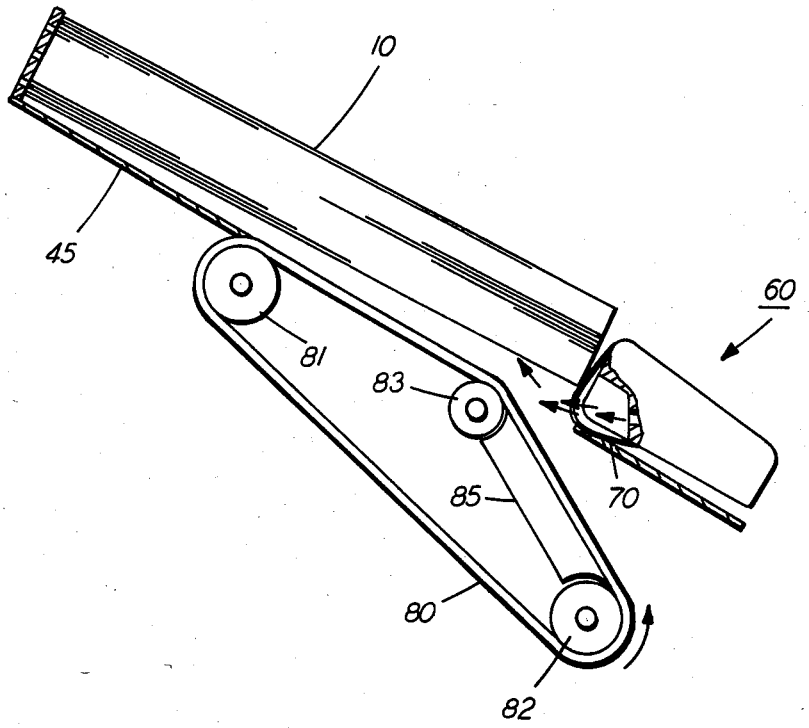
FIG. 3 is an enlarged partial side view of another aspect of the present invention.

In accordance with another aspect of the present invention, an alternative bottom stacking apparatus is shown in FIG. 3. Incoming sheets directed toward stack 10 are attracted to perforated belt 80 by vacuum plenum 85. Belt 80 is supported in a bi-sloped configuration by support rollers 82 and 83 and drive roller 81. Stack 10 is levitated within tray 45 by air knife 60 and as the trail edge of the sheet being transported by belt 80 leaves the grip of vacuum plenum 85, it is lifed up against the rest of the stack by the force of the air pressure from air knife 60. The air knife has expansible perforated seal means 70 attached thereto that serves as a registration edge for the sheets in the stack, as a seal means to insure that a significant portion of the air knife flow is caused to flow up the front of the stack as well as a help to levitate each sheet to the bottom of the stack, and as a means to prevent sheets from slipping under the air knife when the flow and belt movement are stopped. Alternatively, the seal means 70 could be one continuous piece or multiple individual fingers. The angled bi-sloped feed belt also helps to insure that a maximum amount of air pressure from air knife 60 is directed against the stack and that each sheet leaving the grip of vacuum plenum 85 is immediately lifed to the bottom of the stack since the beam strength of the sheet will automatically lift the trail end of the sheet from the belt thereby allowing easy access of air pressure from the air knife to the underside of the sheet in order to lift it up to the bottom of the stack.

It should be now apparent that an improved bottom stacking apparatus has been disclosed that employs deflectable articulating seal means to seal the area between the front of a stack of sheets and an air knife and the area between the air knife and a transport belt. The seal means increases the efficiency of the air knife by insuring less loss of air.

While I have described preferred embodiments of the invention it is to be understood that the invention is not limited thereto but may be otherwise embodied within the scope of the following claims.

What is claimed is:

1. A bottom sheet stacking apparatus, comprising:

a sheet tray adapted to receive a stack of sheets, said tray including a feed belt means for forwarding sheets into said tray and rear and side wall means that form an air tight seal around the stack of sheets, said rear wall serving as a registration edge for incoming sheets into the tray;

air knife means located adjacent the front of said tray, said air knife means being adapted to float all sheets located within said tray;

deflectable articulating seal means forming a front wall of said tray and adapted to positively seal the area of the sheet stack adjacent said air knife when said air knife is actuated; and vacuum port means located adjacent said feed belt means a minimal distance before the front edge of the sheet stack, said vacuum port means being adapted to pull sheets against said feed belt means as they are forwarded by said feed belt means toward said rear wall of said tray until their trail edges pass said vacuum port means, thereafter the sheets are forced up against the floating stack of sheets by said air knife means.

2. The apparatus of claim 1, including additional deflectable articulating seal means attached to a surface of said air knife means and positioned adjacent said feed belt means in order to minimize the escape of air between said feed belt means and said air knife means.

3. The apparatus of claim 2, wherein said additional deflectable articulating seal is substantially self-energized.

4. The apparatus of claim 1, wherein said deflectable articulating seal means comprises multiple, individual members which are adapted when energized to contact a surface of the stack of sheets.

5. The apparatus of claim 4, wherein said feed belt means comprises a plurality of individual belts and said vacuum means draws air between the belts.

6. The apparatus of claim 5, wherein the vacuum flow within said vacuum port means is preferably less than the flotation flow of said air knife means so as to not upset levitation of the stack of sheets.

7. The apparatus of claim 1, wherein said deflectable articulating seal means is an integral part of said air knife means.

8. A bottom sheet stacking apparatus, comprising:

an inclined sheet tray adapted to receive a stack of sheets, feed belt means for forwarding sheets into said tray, said feed belt means having a bi-sloped portion that includes an area inclined away from said tray and air knife means positioned in contacting relation with the stack when energized and adapted to supply air pressure to the diverging point of said bi-sloped portion of said feed belt means in order to lift the trail edge of sheets up against the stack.

9. The apparatus of claim 8, wherein a significant portion of the flow of said air knife means is caused to flow up the front of the stack of sheets in order to increase the levitation of sheets to the bottom of the stack of sheets.

10. The apparatus of claim 9, wherein said air knife means includes a portion thereof enclosed by an expansible perforated seal means that serves to register sheets in the stack, seal the front of the stack and assist in levitating each incoming sheet up against the bottom of the stack.

11. The apparatus of claim 10, wherein said seal means prevents sheets slipping from beneath the stack once the air knife means and feed belt means are deactuated.

* * * * *